United States Patent [19]

Thomas

[11] 3,999,228

[45] Dec. 28, 1976

[54] INVALID LIFTING AND WALKING DEVICE

[76] Inventor: Dale H. Thomas, 8614 W. Denver Ave., Milwaukee, Wis. 53224

[22] Filed: Oct. 10, 1975

[21] Appl. No.: 621,423

[52] U.S. Cl. ..... 5/86; 5/81 R; 297/5; 297/DIG. 4

[51] Int. Cl.[2] ..... A47B 83/04; A47D 13/04

[58] Field of Search ..... 5/81, 83, 86–89; 128/75, 524, 537; 280/79.2, 250 R; 297/4, 5, DIG. 10, DIG. 4

[56] References Cited

UNITED STATES PATENTS

| | | | |
|---|---|---|---|
| 2,792,052 | 5/1957 | Johannesen | 5/83 |
| 2,891,256 | 6/1959 | Scully | 5/87 |
| 3,252,704 | 5/1966 | Wilson | 5/83 |
| 3,629,880 | 12/1971 | Van Rhyn | 5/86 |
| 3,807,795 | 4/1974 | Weant et al. | 5/86 |

*Primary Examiner*—Casmir A. Nunberg

[57] ABSTRACT

A power operated invalid lifting and walking device which is operated by the invalid. The invalid lifts himself to a standing position with a power hoist attached to the device. While supported in the standing position by the hoist, the invalid can propel the device by holding onto a handle bar and pushing against the floor with his feet.

5 Claims, 2 Drawing Figures

INVALID LIFTING AND WALKING DEVICE

The invention is directed generally to an invalid lifting and walking device and more particularly to such a device which can be manipulated by the invalid himself.

More and more people are living to an older age. Unfortunately, however, many of these people are unable to take care of themselves. Some become invalids who require assistance whenever they are moved. Such people are therefore unable to get around unless someone with sufficient strength is available to help them.

In many cases the invalid may be so heavy that two people are required to assist him. Because of the cost or lack of availability of such people many different invalid supporting devices have been developed. The following patents are examples of some prior art invalid supporting devices: U.S. Pat. No. 1,878,785 issued to B.C. Leavitt on Sept. 20, 1932; U.S. Pat. No. 2,339,007 issued of F. Gahm on Jan. 11, 1944; U.S. Pat. No. 2,516,553 issued to H. D. Cole on July 25, 1950; and U.S. Pat. No. 2,913,738 issued to C. W. Wise on Nov. 24, 1959. It should be understood that this list is not intended to be exhaustive of the prior art but is merely a list of representative prior art patents.

In some cases an invalid is not completely paralzed, but is merely incapable of completely supporting his own weight. Such invalids can manage a wheel chair and are thus able to move about quite well. However, many such people still require assistance to get in and out of the wheel chair or in and out of their bed.

It is the intention of this invention to provide an invalid lifting and walking device which can be operated by the invalid without additional assistance. Such a device will permit the invalid to raise himself from a sitting or lying position to a standing position. When in the standing position the invalid can move the lifting and walking device by himself to a different location and then lower himself to either the sitting or lying position. As an example, an invalid could raise himself from the bed and while supported move himself to the bathroom and lower himself onto the toilet without any assistance.

It is therefore the general object of this invention to provide an invalid lifting and walking device which overcomes the shortcomings of the prior art devices.

A more specific object of the invention is to provide a device of the above described character which can be manipulated by the invalid himself without additional assistance.

An additional object of the invention is to provide a device of the hereinbefore described type which includes a rolling frame having a power operated hoist positioned to support the invalid in a standing position whereby he can move the device himself.

A further object of the invention is to provide a device of the hereinbefore described type wherein the hoist can be attached to the invalid while he is sitting or lying in a bed and which can be operated by the invalid to raise himself to the device supported standing position.

These and other objects of the subject invention will become more fully apparent as the following description is read in light of the attached drawings wherein.

Figure 1:
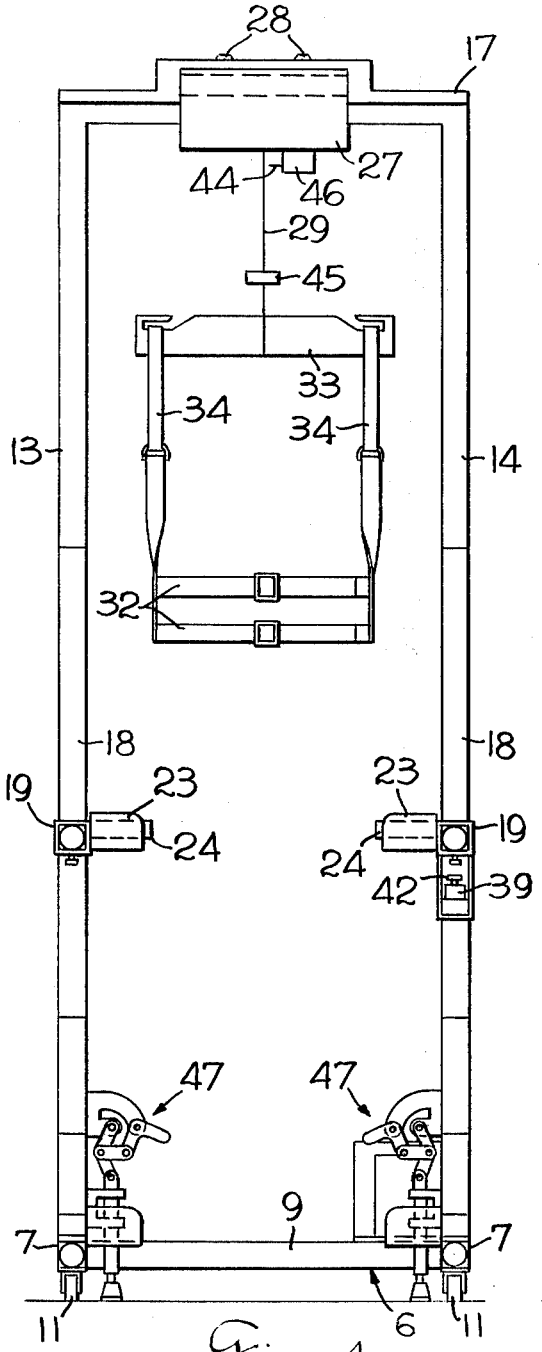
FIG. 1 is a front elevation of a preferred form of the device.
Figure 2:
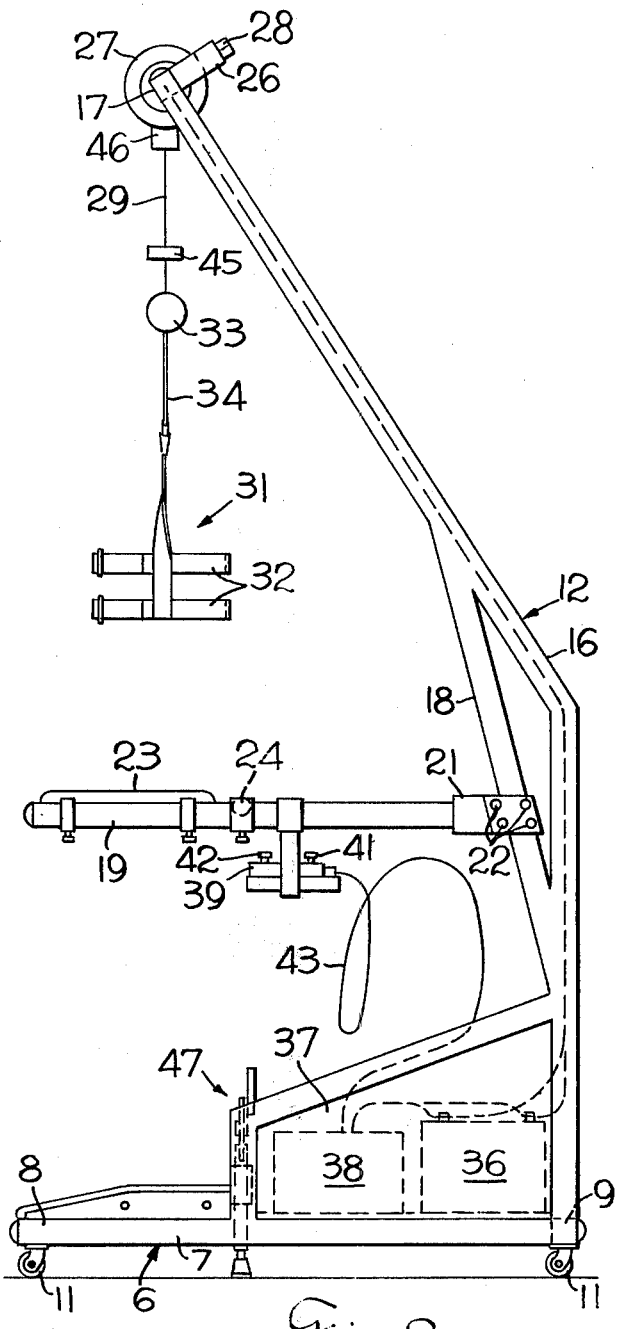
FIG. 2 is a side elevation of the device of FIG. 1.

Referring to the drawings where like reference characters indicate the same or similar components the invalid lifting and walking device is supported on a base generally designated 6. The base 6 is composed of a pair of spaced legs 7 having their rear or terminal ends 8 free of interconnection to permit unencumbered movement therebetween. The front or opposite ends of the legs 7 are rigidly connected together by a cross member 9. The legs 7 and the cross member 9 may be of angular or tubular (as shown) cross sectional configuration and may be of any light weight material having sufficient strength for the intended purpose such as aluminum. Furthermore, the legs and cross members may be connected together in any conventional manner such as by welding or riveting depending on the type of material employed.

Ground engaging members, preferably four, are connected to the bottom of the base 6. They may be conventional casters having swivel rollers to permit easy movement of the device in any direction.

An upstanding support 12 is rigidly connected to the front end of the base 6 remote from the terminal ends 8. The support 12 may be constructed of a single element or as herein shown for purposes of illustration may include a pair of spaced elements 13 and 14. The support elements 13 and 14 may be curved or as herein shown for purposes of illustration may be angled rearward as shown at 16. The angle 16 is such that the upper ends 17 extend substantially over the terminal ends 8 of the legs 7. Furthermore the upper ends 17 are spaced above the ground engaging casters 11 a sufficient distance to permit a person to stand under the upper ends 17. Struts 18 may be provided across the angle 16 for added strength if necessary.

A pair of arm rests 19 are connected to the upstanding support 12 and extend rearwardly substantially parallel to the legs 7. As herein shown for purposes of illustration the arm rests are adjustably connected to the struts 18. This adjustable connection may be made in any conventional manner and as herein shown includes a sleeve 21 rigidly connected to the arm rest 19 and having an opening therethrough for sliding movement up and down the struts 18. A pair of set screws 22 are provided to lock the arm rests in the desired adjusted position. Each arm rest 19 may be provided with a pad 23 on which the invalids arm may rest. Additionally handle bars 24 are provided on the arm rest to assist the invalid in manipulating the device. Both the pad 23 and handle bars 24 are adjustably attached to the arm rest in the manner shown.

The upper ends 17 are rigidly connected together by a hoist bar 26. The connection of the hoist bar 26 to the upper ends 17 may be effected in any conventional manner such as by welding. An electric hoist 27 is herein shown for purposes of illustration connected to the hoist bar 26. Depending on the configuration of the particular hoist used the frame of the hoist may be attached to the hoist bar by cap screws 28. It should be understood that while it is preferred to have the hoist 27 connected to the hoist bar at the top of the device 6, the hoist may be attached at any convenient location so long as the hoist cable 29 depends from a high point on the device.

An invalid harness 31 is releasably attached to the hoist cable preferably in the manner shown. The harness is shown as a pair of spaced torso straps 32 provided with adjustable buckles for attachment to an invalid. It should be understood that the harness alone does not form a part of this invention and therefore may be of any design most comfortable for the invalid. The two torso straps are attached to a cross bar 33 by a pair of adjustable straps 34 which extend vertically on either side of the invalid. The cross bar 33 is in turn connected to the hoist cable 29.

The electric hoist is powered by direct current supplied by a storage battery indicated at 36. A compartment 37 is provided for the battery 36 and any necessary control relay 38. A control box 39 is connected into the electrical circuit and is provided with the necessary button switches 41 and 42 for operating the hoist. The control box is provided with an elongated cable 43 for remote control of the hoist.

The operation of the invalid lifting and walking device is as follows. If the invalid is lying in bed or if sitting in a wheel chair, the device is moved near the invalid so the harness 31 can be attached. The terminal ends of the legs 7 either extend under the bed or straddle the wheel chair so the upper end 7 of the upright member extend over the invalid. The invalid takes the control box 31 and depresses the button 41 to raise himself. to a standing position. The control buttons 41 and 42 are both biased to an off position so when the button is not depressed the hoist will come to an immediate stop. For safety sake an automatic hoist stop is provided. A trip 43 is attached to the hoist cable 29. When the trip 43 contacts the lever 44 the switch 46 automatically stops the hoist. The trip 43 can be adjusted along the length of the hoist cable 29 depending on the height of the invalid using the device.

Once the invalid has raised himself to the desired height he replaces the control box 39 in its support on the arm rest 19. The invalid is now in a standing position supported by the harness 31. He is facing the upright member 12 with his arms resting on the arm rests 19. Since there are no connections between the rearward facing ends of the legs 7 and arm rests 19, the invalid is free to move within this area. By holding on to the handle bars 24 the invalid can propell the device with his feet. The proper position of the arm rests permits the invalid to both propell and steer the device. Naturally padding is provided on the device at strategic locations to protect the invalid. Also a brake 47 may be provided to hold the device in position while the invalid is operating the hoist.

From the above description it can be seen that an invalid lifting and walking device has been provided which can be operated by the invalid himself either while supported by the device or while in a position not supported by the device. With this device, the invalid has much more freedom since he can move himself from one location to another and can raise or lower himself to a standing, sitting or lying position without help from another person.

The embodiments of the invention in which an exclusive property or privilege is claimed are defined as follows:

1. A power operated invalid lifting and walking device controlled and propelled by the invalid and adapted to permit an invalid to lift himself between lying, sitting and standing positions comprising: a base having a pair of spaced legs with the terminal ends thereof being free of interconnection to permit unencumbered movement between said legs from said terminal ends; ground engaging members connected to said legs to permit rolling movement of said device; an upstanding support connected to said base at a location remote from said terminal ends having the upper end thereof vertically spaced from and substantially overlying said terminal ends to permit an invalid to stand on the ground between said legs under said upper end, said legs being constructed and arranged to permit same to straddle and pass under an invalid support whereby said upper ends extends over said support; a power operated hoist connected to said device; harness means connected to said hoist depending from said upper end for universal movement relative thereto and for connection to an invalid, said hoist being selectively operable to raise and lower said harness supported invalid between lying, sitting and standing positions; and means for operating said hoist removably attached to said device for control of said hoist by said invalid when in said supported standing position said harness and said control being substantially coextensively extendable from said device for remote control of said hoist by said harness supported invalid when in a position other than said standing position.

2. A power operated invalid lifting and walking device controlled and propelled by the invalid and adapted to permit an invalid to lift himself between lying, sitting and standing positions comprising: a base having a pair of spaced legs with the terminal ends thereof being free of interconnection to permit unencumbered movement between said legs from said terminal ends; ground engaging members connected to said legs to permit rolling movement of said device; an upstanding support connected to said base at a location remote from said terminal ends having the upper end thereof vertically spaced from and substantially overlying said terminal ends to permit an invalid to stand on the ground between said legs under said upper end, said legs being constructed and arranged to permit same to straddle and pass under an invalid support whereby said upper ends extends over said support; a pair of spaced arm rests connected to said upstanding support extending substantially parallel to said legs and located at substantially elbow height of a standing person, the terminal ends of said arm rests being free of interconnections to permit unencumbered movement therebetween; a power operated hoist connected to said device; harness means connected to said hoist and depending from said upper end for universal movement relative thereto and for connection to an invalid, said hoist being selectively operable to raise and lower said harness supported invalid between lying, sitting and standing positions; and means for operating said hoist removably attached to one of said arm rests for control of said hoist by said invalid when in said supported standing position said harness and said control being substantially coextensively extendable from said arm rest for remote control of said hoist by said harness supported invalid when in a position other than said standing position.

3. The device set forth in claim 2 wherein said arm rests are releasably connected to said upstanding support to permit adjustable vertical positioning thereof.

4. The device set forth in claim 2 and further providing handle bars connected to said arm rests to permit the invalid to steer said device.

5. The device set forth in claim 2 and further comprising storage battery means supported on and carried by said device to supply electric current for operation of said hoist.

* * * * *